United States Patent [19]

Pullen

[11] Patent Number: 4,995,138

[45] Date of Patent: Feb. 26, 1991

[54] VACUUM APPARATUS FOR DEBRIS COLLECTION

[76] Inventor: Lawrence H. Pullen, 24301 Kakae Dr., Damascus, Md. 20872

[21] Appl. No.: 434,858

[22] Filed: Nov. 6, 1989

[51] Int. Cl.[5] ..... A47L 5/12

[52] U.S. Cl. ..... 15/340.1; 15/315; 15/354; 15/414

[58] Field of Search ..... 15/315, 340.1, 414, 15/354; 406/39; 193/16

[56] References Cited

U.S. PATENT DOCUMENTS

| | | | |
|---|---|---|---|
| 3,348,258 | 10/1967 | Daneman | 15/340.1 |
| 3,481,440 | 12/1969 | Jackoboice | 193/16 |
| 3,495,878 | 2/1970 | Hanaya | 193/16 |
| 3,675,267 | 7/1972 | Klawitter | 15/340.1 |
| 4,019,219 | 4/1977 | Willenborg | 15/340.1 |
| 4,199,837 | 4/1980 | Fisco, Jr. | 15/315 |
| 4,659,262 | 4/1987 | van Aalst | 15/340.1 |

*Primary Examiner*—Philip R. Coe
*Assistant Examiner*—Pat Brinson
*Attorney, Agent, or Firm*—Crickenberger & Associates

[57] ABSTRACT

A vacuum apparatus for debris collection comprises a motor vehicle having a vacuum tank collector and means for generating a vacuum. A horizontally and vertically extendible tube is connected to the vacuum tank collector, and extendible support linkage supports the tube along its length. Means are provided for extending and retracting the support linkage and the tube with respect to the vehicle and the ground while pivoting the tube and support linkage on a support base member pivotally mounted on the vehicle to provide a wide range of motion over the ground surface.

3 Claims, 2 Drawing Sheets

VACUUM APPARATUS FOR DEBRIS COLLECTION

BACKGROUND OF THE INVENTION

Mobile vacuum debris collectors are not new in the art. These have been a number of such proposed structures, but none has been accepted for widespread commercial use.

Examples of prior art devices are shown in the following U.S. patents:

U.S. Pat. No. 3,150,404 issued 09-29-64 to Johnson

U.S. Pat. No. 3,348,258 issued 10-24-67 to Daneman

U.S. Pat. No. 3,506,998 issued 04-21-70 to Perry

U.S. Pat. No. 3,675,266 issued 07-11-72 to Murray et al.

U.S. Pat. No. 3,942,214 issued 03-09-76 to Maasberg

U.S. Pat. No. 4,019,219 issued 04-26-77 to Willenborg

It is an object of the present invention to provide a vacuum debris collection apparatus having features which are lacking in the prior art.

SUMMARY OF THE INVENTION

This invention relates to a fully automated vacuum debris collection apparatus pivotally mounted on a motor vehicle for picking up debris or removing trash and litter from highways, streets, alleys, and other surfaces. The use of a flexible vacuum type tube or nozzle apparatus is known in the art. However, this invention provides greater flexibility, mobility, and range as well as maximum efficiency and control, and, in general, provides an improved mechanism for the collection of debris.

The invention offers a fully automated vacuum debris collecting apparatus for both collecting and emptying the debris from the apparatus. The vacuum debris collection apparatus can be mounted on a motorized vehicle with or without a hydraulically-driven dumping mechanism for the debris container. The vacuum collection apparatus may be mounted on the front, rear or side of the vehicle.

A flexible extendible tube is attached to a vacuum container mounted on the vehicle chassis and is supported by a pivotally mounted extendible support apparatus.

The operator can control the extendible support apparatus to effect forward, backward, vertical, and horizontal motion in a precise, efficient and effective manner. When the controls for operating the pivotally mounted extendible support apparatus are located in the cab at the front of the vehicle, the operation of the vacuum apparatus does not obstruct the vision of the operator of the vehicle. After the debris has been collected, the pivotally-mounted extendible support apparatus can be retracted into a compact position.

The extendible support apparatus uses double-acting hydraulic cylinders to extend the support apparatus in forward, backward, upward, and downward motions while pivoting the apparatus about an axis mounted on the vehicle.

BRIEF DESCRIPTION OF THE DRAWING

The invention will now be described by way of example and with reference to the accompanying drawing in which.

DESCRIPTION OF THE INVENTION

Figure 1:
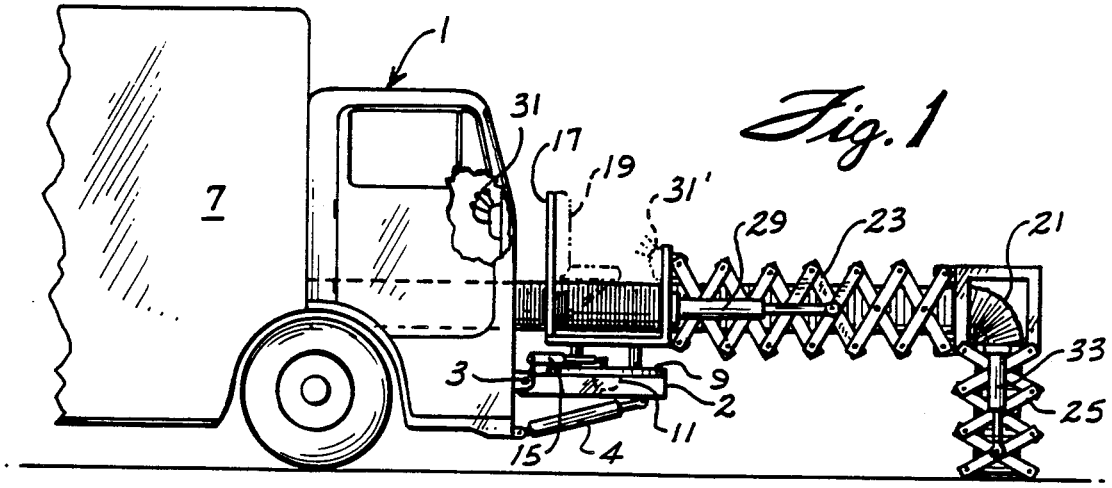
FIG. 1 is a side view of a motor vehicle showing an apparatus incorporating the features of the invention mounted on the front thereof.
Figure 2:
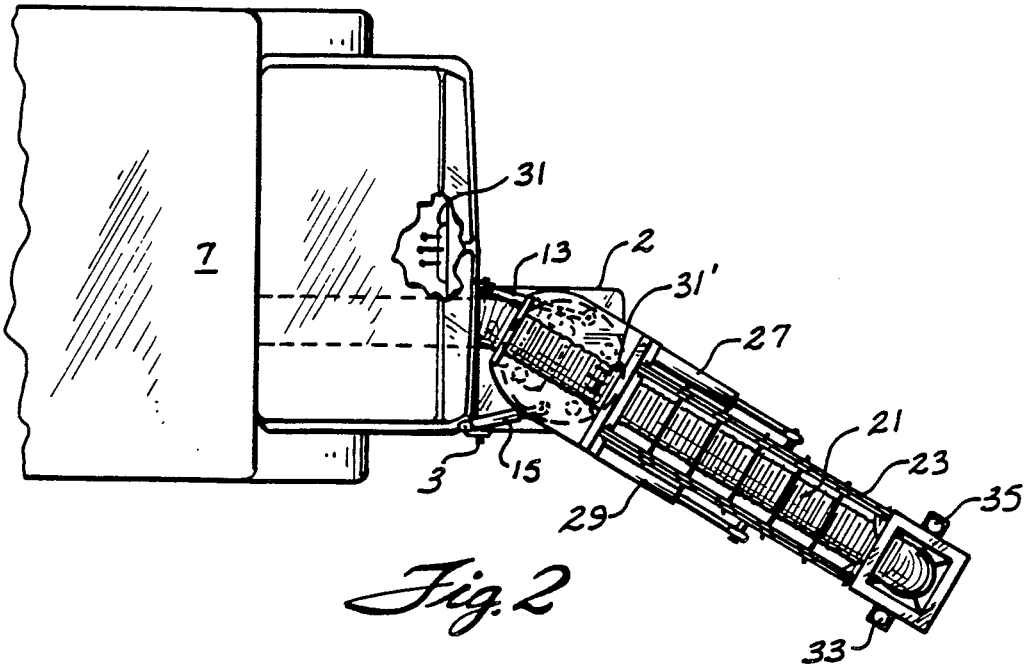
FIG. 2 is a top view of the apparatus shown in FIG. 1 in which the extendible tube has been pivoted toward the curb side of the vehicle.
Figure 3:
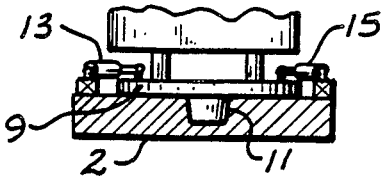
FIG. 3 is a partial cross-section showing the pivotal mounting of the support base member and the double-acting hydraulic cylinders that control the pivoting action.
Figure 4:
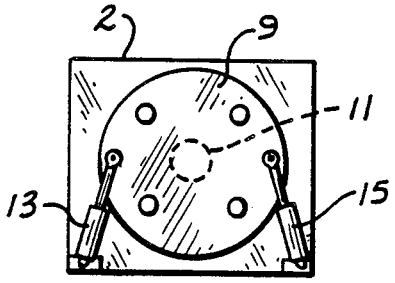
FIG. 4 is a top view of the support base member shown in FIG. 3.

The invention will be understood more readily by referring to the drawings in which FIG. 1 shows a motor vehicle 1 having a front platform member 2 pivotally mounted thereon about a horizontal axis by hinge pin 3 to permit raising and lowering of the front portion of platform member 2. A double-acting hydraulic cylinder 4 is connected between the body of the motor vehicle 1 and the platform member 2 to effect the desired raising and lowering action. The motor vehicle 1 carries a vacuum tank collector 7 adapted to hold the debris collected during the operation of the apparatus.

A support base member 9 is pivotally mounted at 11 on front platform member 2. Double-acting hydraulic cylinders 13 and 15 are attached to and control the pivotal motion of the support base member 9. The operator preferably sits in the cab of the vehicle, and the apparatus of the invention may be operated by the vehicle operator. A U-shaped platform 17 having an operator's seat 19 may be attached to support base member 9 and pivot therewith if external operation of the apparatus is desired.

An extendible tube 21 has one end connected to the vacuum tank collector 7. Extendible tube 21 is supported throughout its length by extendible support linkage comprising a horizontal section 23 and a vertical section 25. Double-acting hydraulic cylinders 27 and 29 act on the horizontal support linkage 23 to extend and retract it under the control of the operator by way of the control means shown at 31, which may be mounted in the cab or at 31, when external operation is desired. Similarly, double-acting cylinders 33 and 35 control the vertical movement of vertical support linkage 25. The control means 31 are connected to and control the operation of all of the hydraulic cylinders described herein by conventional interconnection means which are not shown and which do not form a part of this invention.

Figure 5:
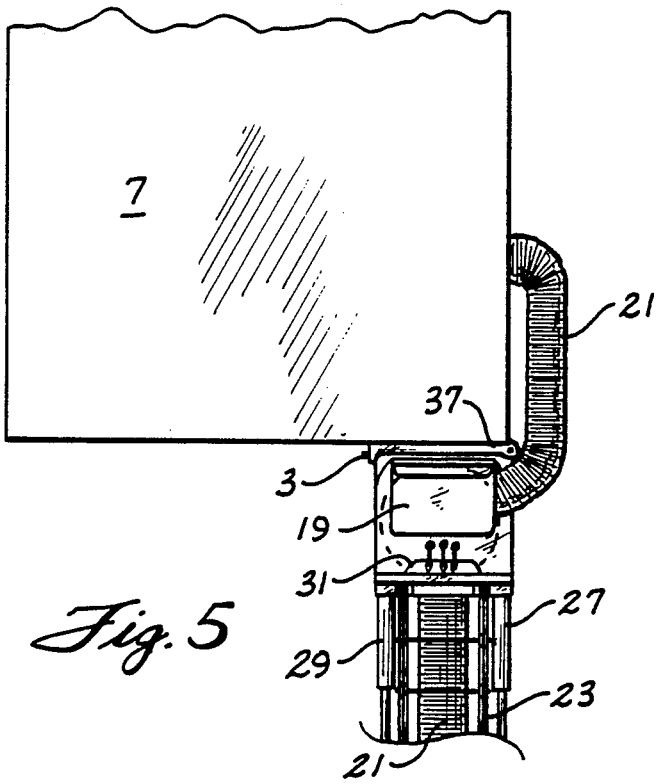
FIG. 5 is a top view of an alternate embodiment of the invention in which the debris collection apparatus of the invention is mounted on the right rear corner of the vehicle and extending rearwardly.
Figure 6:
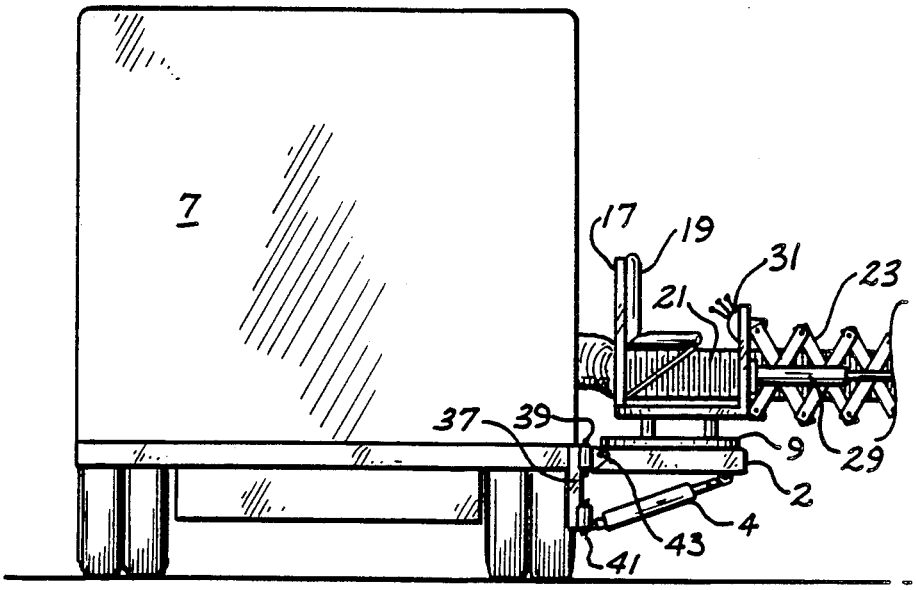
FIG. 6 is a rear view of the vehicle in which the debris collection apparatus of the invention is mounted on the right rear corner of the vehicle and extending outwardly from the side of the vehicle.

In the alternate embodiment of the invention shown in FIGS. 5 and 6, the debris collection apparatus is pivotally mounted on a rear corner of the body of the vehicle by a combination horizontal and vertical hinge member 37 which forms an extension of the vehicle body depending downwardly therefrom. Hinge member 37 has two vertical hinge portions 39 and 41 which support platform member 2 in its movement from a rearwardly extending position to a sidewardly extending position. Horizontal hinge portion 43 receives hinge pin 3 as shown in FIG. 1 to enable the raising and lowering of platform member 2. The parts of the apparatus shown in FIGS. 5 and 6 are numbered to correspond with the apparatus shown in FIGS. 1 to 4. In the alternate embodiment of FIGS. 5 and 6, the operator is positioned on platform 17 for complete and accurate control of the operation of the apparatus.

Under the control of the operator, the apparatus can be moved across a wide area in front of the motor vehicle in the preferred embodiment or to the rear and side as shown in the alternate embodiment, thereby effectively removing debris regardless of uneven terrain or obstacles which might be found in the path of the vehicle. The maneuverability of the extendible tube is unmatched in the prior art, and the apparatus of the invention is thereby enabled to effect efficiency of operation which is unsurpassed.

What is claimed is:

1. The combination with a motor vehicle for collecting debris having a vacuum tank collector and means for generating a vacuum therein comprising a platform member mounted on the front of said motor vehicle for pivotal movement in a vertical plane, first means for producing pivotal motion in said platform member, a support base member mounted on said motor vehicle for pivotal movement in a horizontal plane, second means for producing pivotal motion in said support base member, an extendible tube having one end coupled to the vacuum tank collector and the other end adapted to be moved along the surface of the ground, support linkage for supporting said tube along its length, one end of said support linkage being coupled to said support base member, third means having one end coupled to said support base member and the other end coupled to said support linkage for extending and retracting said support linkage with respect to said support base member, thereby causing said tube to be extended or retracted, whereby said tube is extendible and retractable along its longitudinal axis and pivotal in both horizontal and vertical planes.

2. The combination according to claim 1 wherein said support linkage comprises a horizontal section and a vertical section, fourth means for extending and retracting said vertical section toward and away from the ground, whereby said tube is capable of both horizontal and vertical movement to provide a wide range of motion in movement of the tube over the ground surface.

3. The combination according to claim 2 wherein said first, second, third, and fourth means comprise double-acting, fluid-operated cylinders, and control means for selectively operating said fluid cylinder to produce the desired controlled motion for the collection of debris.

* * * * *